US011316608B1

(12) United States Patent
Wyse et al.

(10) Patent No.: US 11,316,608 B1
(45) Date of Patent: Apr. 26, 2022

(54) WIDEBAND JAMMER NULLING

(71) Applicant: Rockwell Collins, Inc., Cedar Rapids, IA (US)

(72) Inventors: Russell D. Wyse, Center Point, IA (US); Peter M. Sahayda, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 12 days.

(21) Appl. No.: 17/018,784

(22) Filed: Sep. 11, 2020

(51) Int. Cl.
*H04K 3/00* (2006.01)

(52) U.S. Cl.
CPC ..... *H04K 3/228* (2013.01)

(58) Field of Classification Search
CPC ..... H04K 3/228
See application file for complete search history.

(56) References Cited

U.S. PATENT DOCUMENTS

| | | | | |
|---|---|---|---|---|
| 4,612,546 | A | 9/1986 | Rosen | |
| 5,694,416 | A | 12/1997 | Johnson | |
| 6,141,371 | A | 10/2000 | Holmes et al. | |
| 6,327,298 | B1 | 12/2001 | Grobert | |
| 8,224,234 | B1 * | 7/2012 | Schuster | H04K 3/42 455/1 |
| 9,071,386 | B2 | 6/2015 | Dell'Anno et al. | |
| 10,014,892 | B1 | 7/2018 | Leyh et al. | |
| 10,333,764 | B1 * | 6/2019 | Arditti | H04B 10/5561 |
| 2009/0103720 | A1 | 4/2009 | Karayil Thekkoott Narayanan | |
| 2009/0156116 | A1 * | 6/2009 | Sheby | H04K 3/42 455/1 |

FOREIGN PATENT DOCUMENTS

| | | | |
|---|---|---|---|
| GB | 2564570 | A | 1/2019 |
| WO | 2014-031818 | A1 | 2/2014 |

OTHER PUBLICATIONS

Nexperia, Product GaN FETS, URL: https://www.nexperia.com/products/gan-fets/, Printed Jun. 4, 2020.

* cited by examiner

*Primary Examiner* — Sam K Ahn
*Assistant Examiner* — Amneet Singh
(74) *Attorney, Agent, or Firm* — Suiter Swantz pc llo

(57) ABSTRACT

A system and method are disclosed for producing nulls in a wideband jamming signal at specific frequency bands. A nulling signal is determined, either as a modification to one or more of the combined signals, or a separately determined nulling signal generated by combine a separate set of signals. The nulling signal is produced via feedback based on the output of the wideband jamming signal. Alternatively, a trained neural network outputs a nulling signal based on the wideband jamming signal and a desired availability band.

12 Claims, 11 Drawing Sheets

WIDEBAND JAMMER NULLING

BACKGROUND

Wideband jamming signals are produced via a combination of multiple source signal signals (waveforms), each having a distinct amplitude and frequency. Wideband jamming would have enough source signals to occupy an entire frequency range, including bands that would be desirable to have available for periodic communication. Because the wideband jamming signal is a summation of multiple signals, there is no convenient method for leaving narrow bands available; simply excluding signals in the desired band does not leave the band free of jamming signals because nonlinear junction behavior causes self-mixing of all the various signals and every numerical combination of all the signals; harmonics "grow" and "spread" and fill in the adjacent frequencies; excluding those signals may have an adverse impact of the jamming abilities of the wideband jamming signal.

SUMMARY

In one aspect, embodiments of the inventive concepts disclosed herein are directed to a system and method for producing nulls in a wideband jamming signal at specific frequency bands. A nulling signal is determined, either as a modification to one or more of the combined signals, or a separately determined nulling signal generated by combine a separate set of signals.

In a further aspect, the nulling signal is produced via feedback based on the output of the wideband jamming signal. Alternatively, a trained neural network outputs a nulling signal based on the wideband jamming signal and a desired availability band.

It is to be understood that both the foregoing general description and the following detailed description are exemplary and explanatory only and should not restrict the scope of the claims. The accompanying drawings, which are incorporated in and constitute a part of the specification, illustrate exemplary embodiments of the inventive concepts disclosed herein and together with the general description, serve to explain the principles.

BRIEF DESCRIPTION OF THE DRAWINGS

The numerous advantages of the embodiments of the inventive concepts disclosed herein may be better understood by those skilled in the art by reference to the accompanying figures in which:

FIG. 1 4 shows a block diagram of a circuit according to an exemplary embodiment;

DETAILED DESCRIPTION

Figure 1:
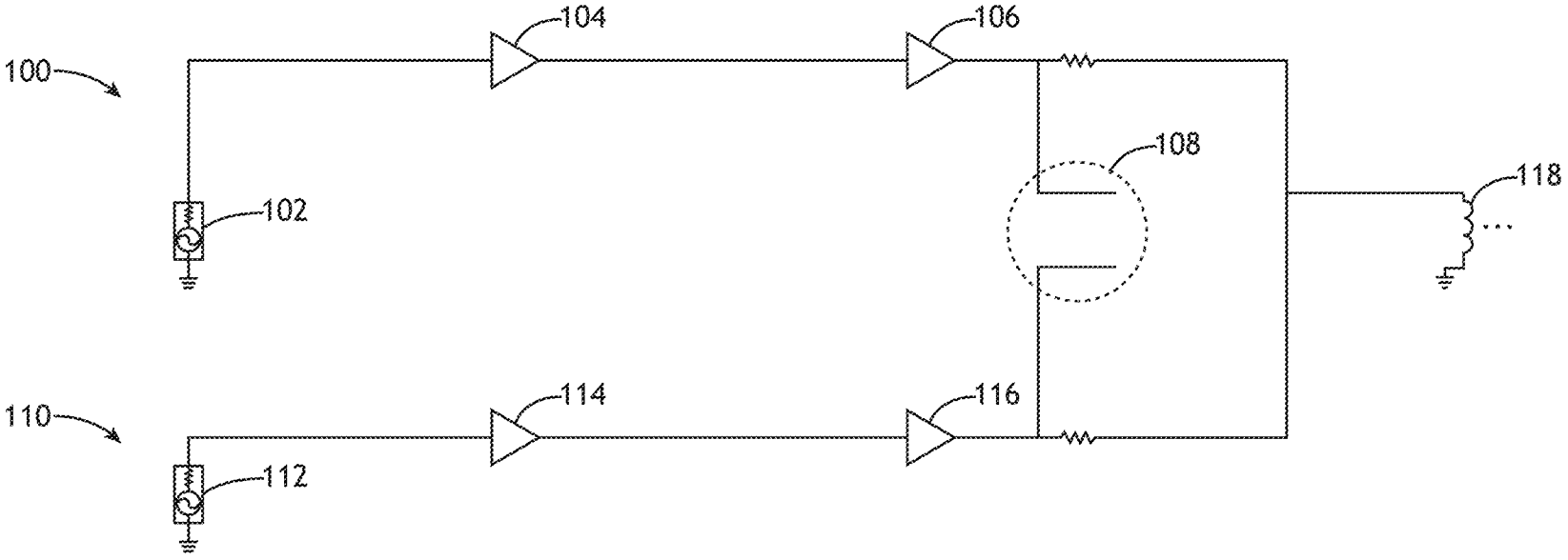

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to a system and method for producing nulls in a wideband jamming signal at specific frequency bands. A nulling signal is determined, either as a modification to one or more of the combined signals, or a separately determined nulling signal generated by combine a separate set of signals.

Referring to FIG. 1, a block diagram of a circuit according to an exemplary embodiment is shown. The circuit includes a first channel 100 having one or more high-speed DAC signal generators 102 configured to produce a plurality of signals that, when combined, produce a wideband jamming signal to cover a desired frequency range. One or more amplifiers 104, 106 amplify the produced wideband jamming signal to a power level sufficient for a GaN wideband differential power amplifier for transmission via an appropriate antenna, and the signal is supplied to the GaN wideband differential power amplifier for transmission via a transformer 118.

In at least one embodiment, a separate processor may analyze the wideband jamming signal via a signal output 108 of the amplifiers 104, 106 to identify one or more signals, or modifications to the amplitude and/or phase of one or more of the plurality of signals, to produce a null in the wideband jamming signal; sampling at the signal output 108 includes nonlinearities that fill in energy if a null is created before the power amplifiers 104, 106. In at least one embodiment, a coupler on the amplifier output samples that output to create the correct pre-distortion on the previous stages so the entire cascade of devices combine the generated signals to create desired cancelation at the final amplifier 106 output.

In at least one embodiment, the one or more signals identified by the processor may be generated by a second nulling channel 110 with a separate high-speed DAC signal generator 112 and one or more separate amplifiers 114, 116. It may be appreciated that the amplifiers 114, 116 in the second channel 110 may operate with a different gain as compared to the amplifiers 104, 106 of the first channel 100. The processor may account for such different gain when identifying the one or more signals.

In at least one embodiment, the separate processor may operate via feedback to identify the one or more signals, or modifications to the amplitude and/or phase of one or more of the plurality of signals.

It may be appreciated that in some embodiments, it is desirable to minimize the number of amplifiers 104, 106, 114, 116 to reduce power consumption and nonlinearity issues. Combining may be done as close to the signal generators 102, 112 as possible.

Figure 2A:
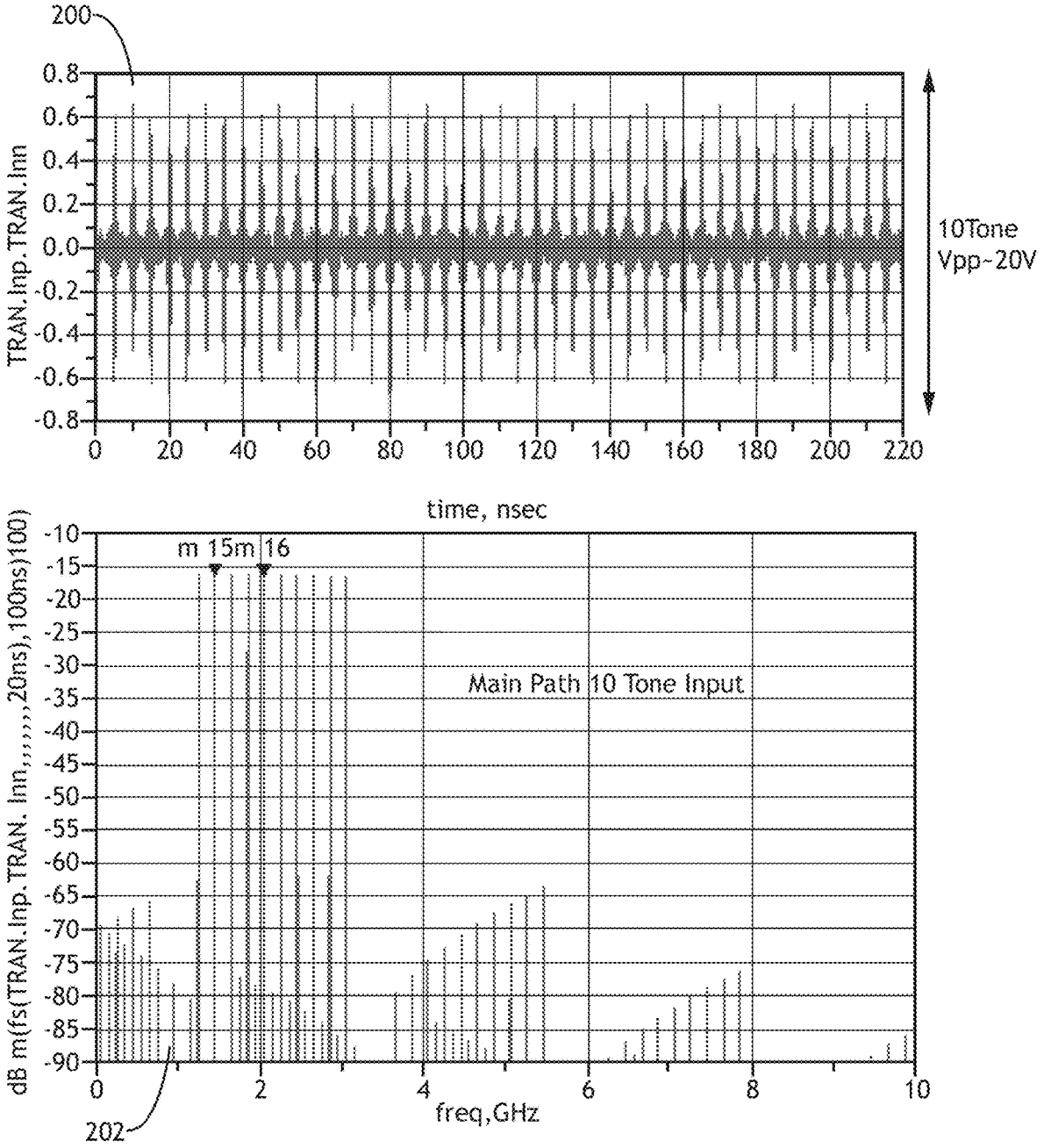
FIG. 2A shows a graph representing input combined signals at the front end of a transmit chain where the individual signals are small and largely free from nonlinear transistor behaviors which can intermodulate and spread energy into accompanying energy sideband frequencies during a process of producing a wideband jamming signal.
Figure 2B:
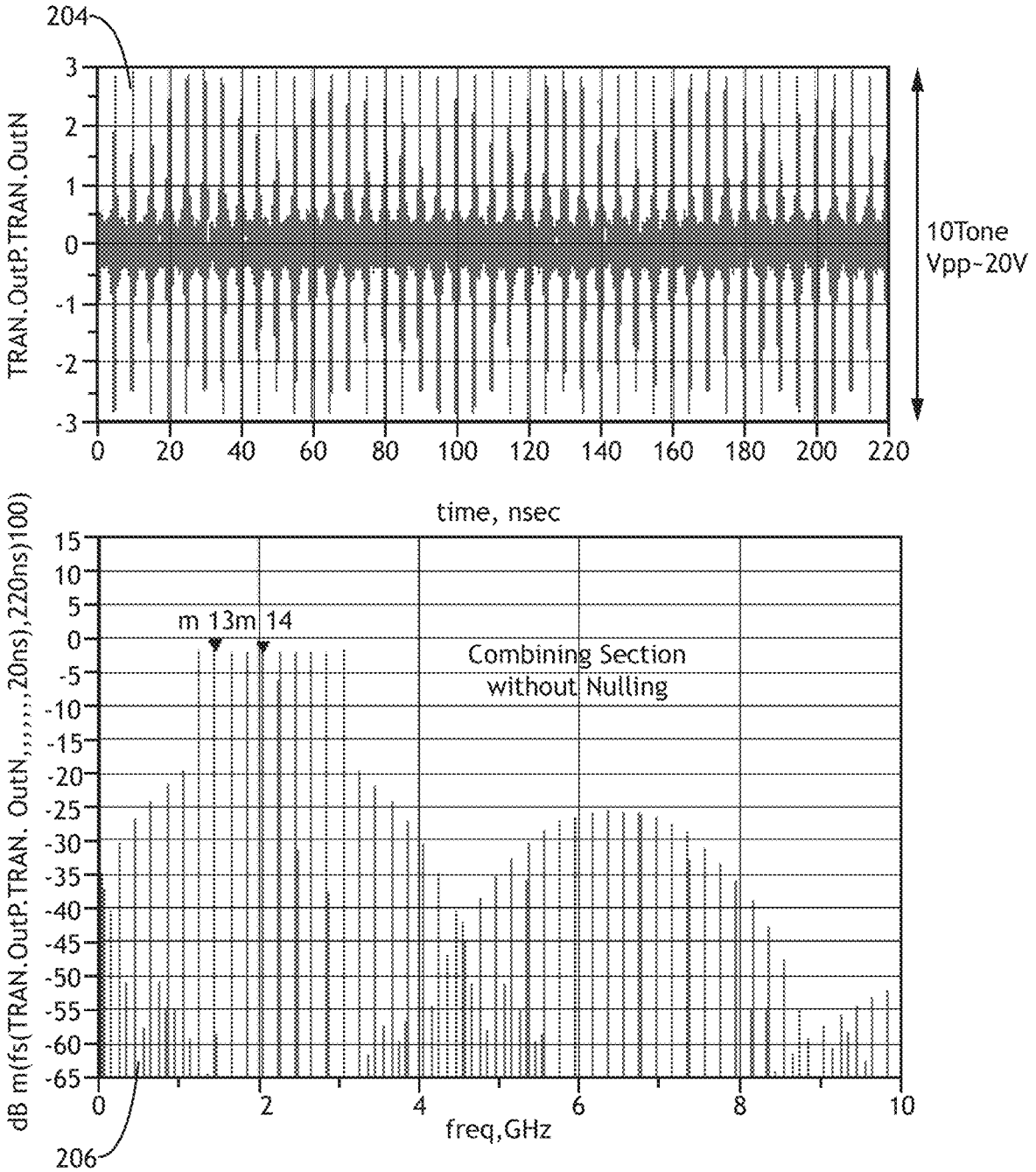
FIG. 2B shows a graph representing signals at the input to the final PA input where the combined signals from 1A are starting to have nonlinear intermodulation effects and spreading of energy into adjacent frequency regions is occurring during a process of producing a wideband jamming signal.
Figure 2C:
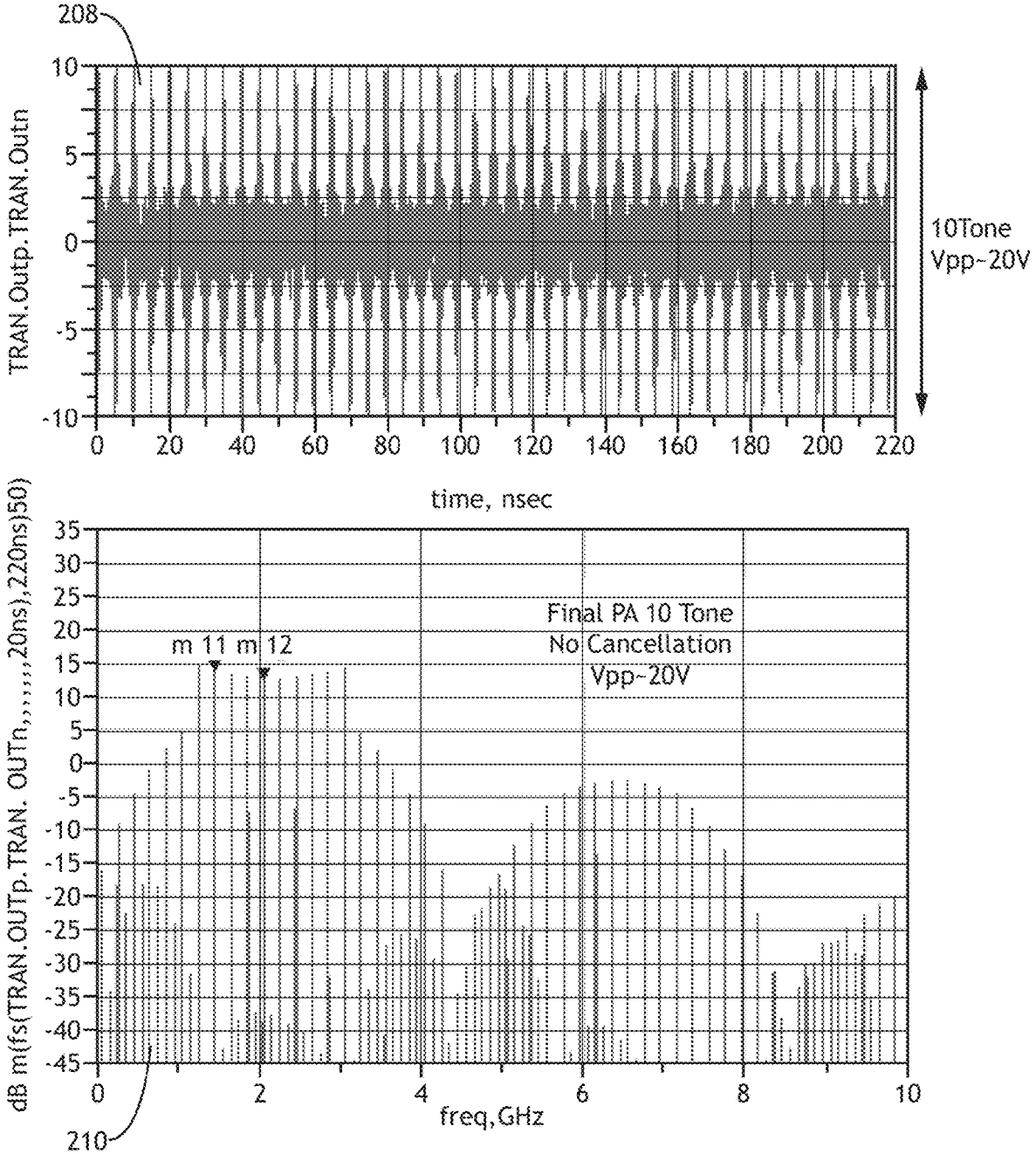
FIG. 2C shows a graph representing signals at the output of the PA which includes all the nonlinear intermodulation effects and spreading of energy into adjacent frequencies during deep compression and nonlinear behavior of the PA during a process of producing a wideband jamming signal.

Referring to FIGS. 2A-2C, a graph representing input combined signals at the front end of a transmit chain, a graph representing signals at the input to the final PA input, and a graph representing signals at the output of the PA are shown. Signals along the transmit circuit cascade are shown during a process of producing a wideband jamming signal at the output of a high power GaN PA are shown. During a process to produce a wideband jamming output signal spectrum, a plurality of narrower band signals, each having a frequency, amplitude, and phase, are generated by one or more signal generators such as digital-to-analog converters (DACs). In at least one embodiment, an amplitude and frequency distribution 202 may include a twenty independent signal input spectrum for an example wideband jamming cascade; in some embodiments, the amplitude and frequency distribution 202 may include equal amplitudes but independent frequencies. The combined transient waveform 200 highlights the large voltage peak to peak and peak to null variations in the combined signal caused by the different signals aligning and canceling in time due to the different frequencies. The plurality of signals are combined and amplified through a nonlinear pre-driver amplifier and produce a tonal transient output signal 204 having a combined power distribution 206. At this intermediate point in the transmit cascade the intermodulation and spectral spreading of the input signals is already evident as the sidebands around the initial input spectrum frequencies have grown and additional harmonic and intermodulation content is evident. The combined tonal pre-driver output signal 204 is amplified via a high power GaN PA into a final output signal 208 with an output power distribution 210. It is apparent that additional intermodulation and spectral regrowth has occurred in this final stage of the cascade as compared to the previous stage. The output power distribution 210 generally occupies the entire band with no significant availability in desirable communication channels.

Figure 3A:
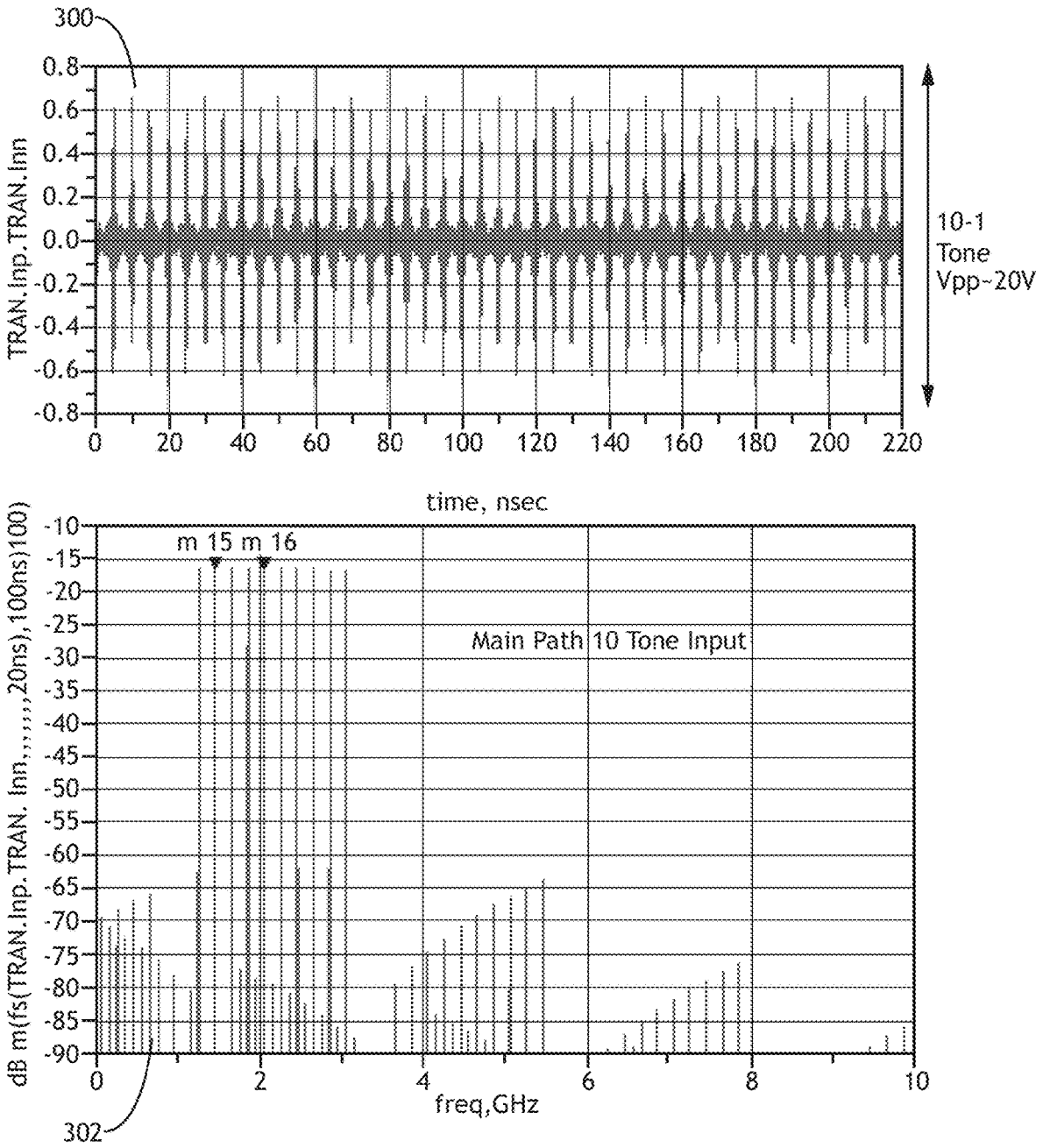
FIG. 3A shows a graph representing input combined signals at the front end of a transmit chain where the individual signals are small and largely free from nonlinear transistor behaviors which can intermodulate and spread energy into accompanying energy sideband frequencies during a process of producing a wideband jamming signal with a null band.
Figure 3B:
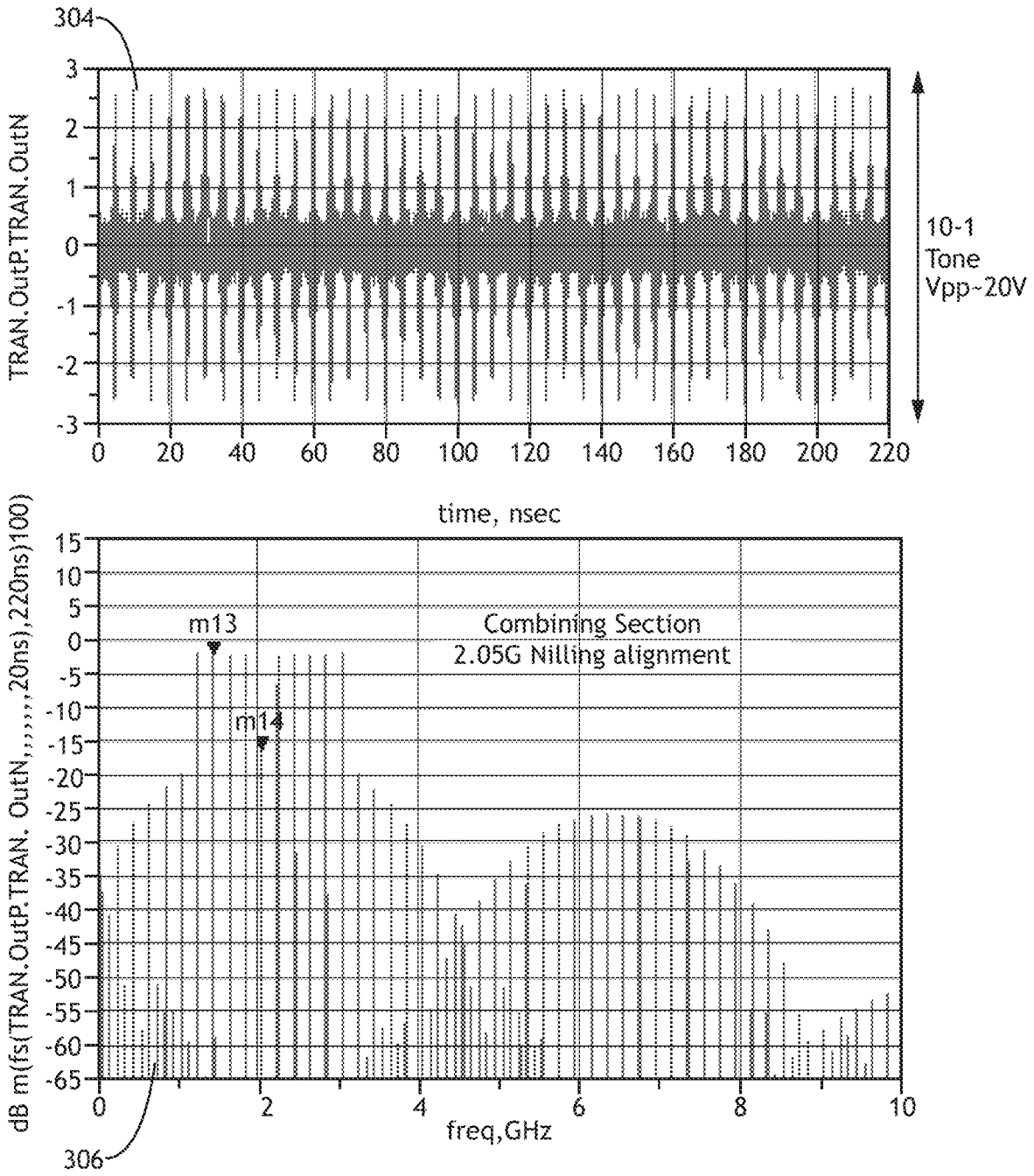
FIG. 3B shows a graph representing signals at the input to the final PA input where the combined signals from 1A are starting to have nonlinear intermodulation effects and spreading of energy into adjacent frequency regions is occurring during a process of producing a wideband jamming signal with a null band.
Figure 3C:
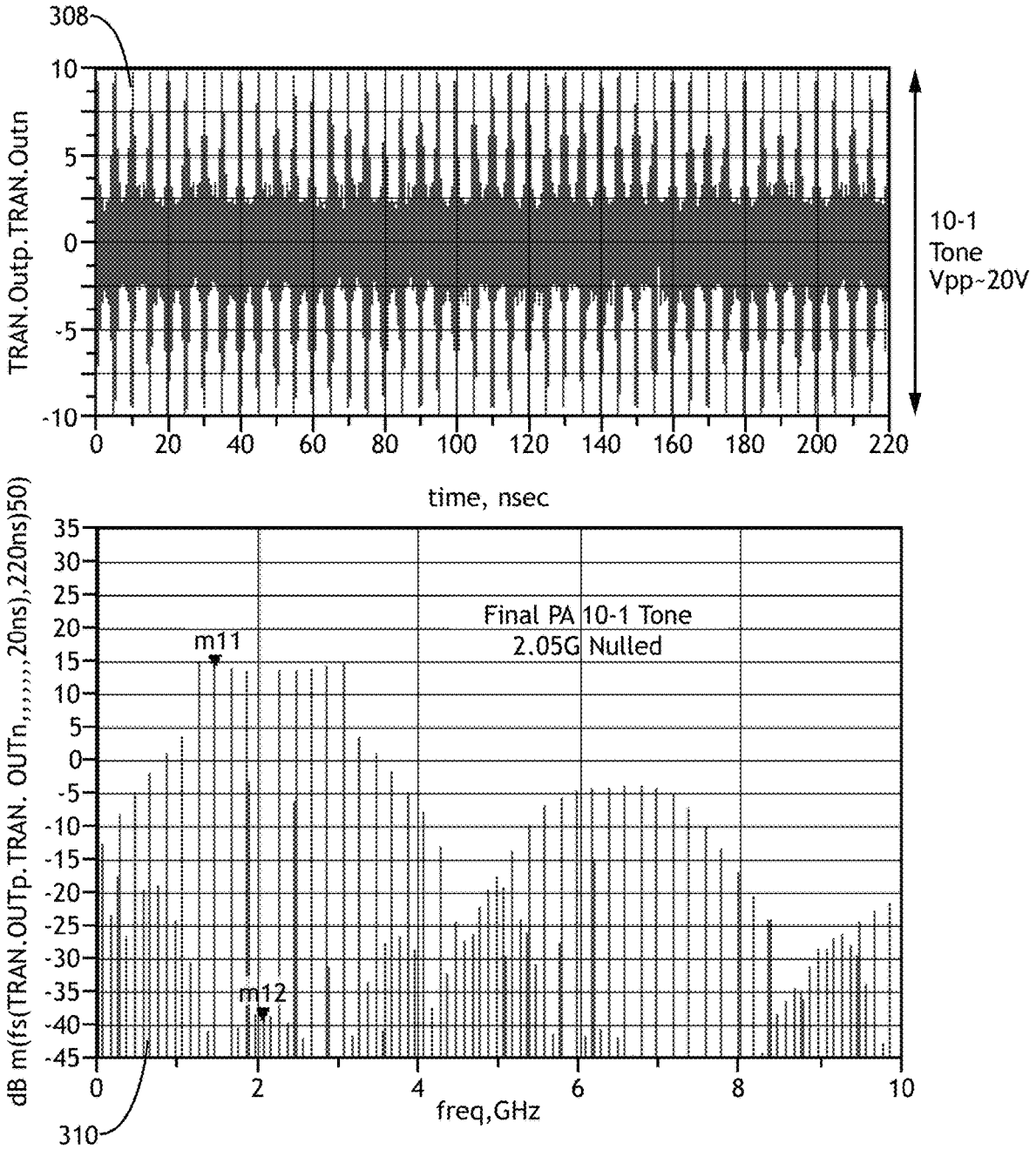
FIG. 3C shows a graph representing signals at the output of the PA which includes all the nonlinear intermodulation effects and spreading of energy into adjacent frequencies during deep compression and nonlinear behavior of the PA during a process of producing a wideband jamming signal with a null band.

Referring to FIGS. 3A-2C, a graph representing input combined signals at the front end of a transmit chain, a graph representing signals at the input to the final PA input, and a graph representing signals at the output of the PA with a null band are shown. Combined transient waveforms 300 having an amplitude and frequency distribution 302 are combined via a nonlinear pre-drive amplifier to an intermediate transient output signal 304 having a combined power distribution 306.

At this intermediate point in the transmit cascade the intermodulation and spectral spreading of the input signals, modifications to the combined transient waveforms 300, or separate nulling signals generated in a separate generation path, produce a preliminary null region 312.

The combined tonal pre-driver output signal 304 is amplified via a high power GaN PA into a final output signal 308 with an output power distribution 310. Nonlinearity behaviors in the high power GaN PA produce a null 314 at a desired band.

In at least one embodiment, the input signals 300 may be modified via a trained neural network, or an algorithm associating the plurality of signals of the input signals 300, or final output signal 308, and a band of desired availability, to identify a signal, one or more tonal components of a signal, or one or more modifications to the plurality of signals, that when incorporated into the transient output signal 304 going into the final high power GaN PA in the cascade produces the null 314 in the combined power distribution 308 at the band of desired availability. It may be appreciated that because of nonlinear behavior of transistor junctions and the interactions of all the input signals, and the response when combining signals, the amplitude and phase of the identified signal are not intuitive, but may be determined via iterative processes. In at least one embodiment, sampling to iterative processing is performed after the final high power GaN PA where each transistor in each circuit along the cascade creates intermodulation, harmonics, and mixing components of all the input signals that spreads energy and signals to more frequencies. Because the gap in energy and frequency is filled in by all the mixing, harmonics, and intermodulation, interactions of the nonlinear devices and circuits, iteration and sampling are required to identify inputs that produce the null 314.

Modifications are applied to the input of the cascade from the DAC's or signal generators used to create the input jamming signals. The modifications unravel the intermodulation, mixing, spreading, regrowth, harmonics, etc. from all the signals going through the nonlinear junctions of the transistors in the circuits to get the best null 314 at the final output signal 308 in the desired band.

In at least one embodiment, the signal, or one or more tonal components of the signal, are produced in a separate generation channel via a separate signal generator, and later combined with the wideband jamming input signals. In at least one embodiment, the one or more signal generators incorporate the one or more modifications to the plurality of signals during generation.

The combined tonal output signal 304 (either modified or including the identified tonal components to produce a preliminary null region 312 that results in the null 314) is amplified via one or more amplifiers into a final output signal 308 with an output power distribution 310 including a null 314 at the band of desired availability. In at least one embodiment, the wideband jamming signal may be amplified independently from the signal configured to produce the null 314. The preliminary null region 312 is necessarily not a deep null on the PA input or pre-driver input. The linear section null attenuation is less than the final null 314 due to the difference in linear versus nonlinear behaviors. The nulling path has fewer signals and requires lower overall output power capability than the wideband jamming signal generation.

Figure 4A:
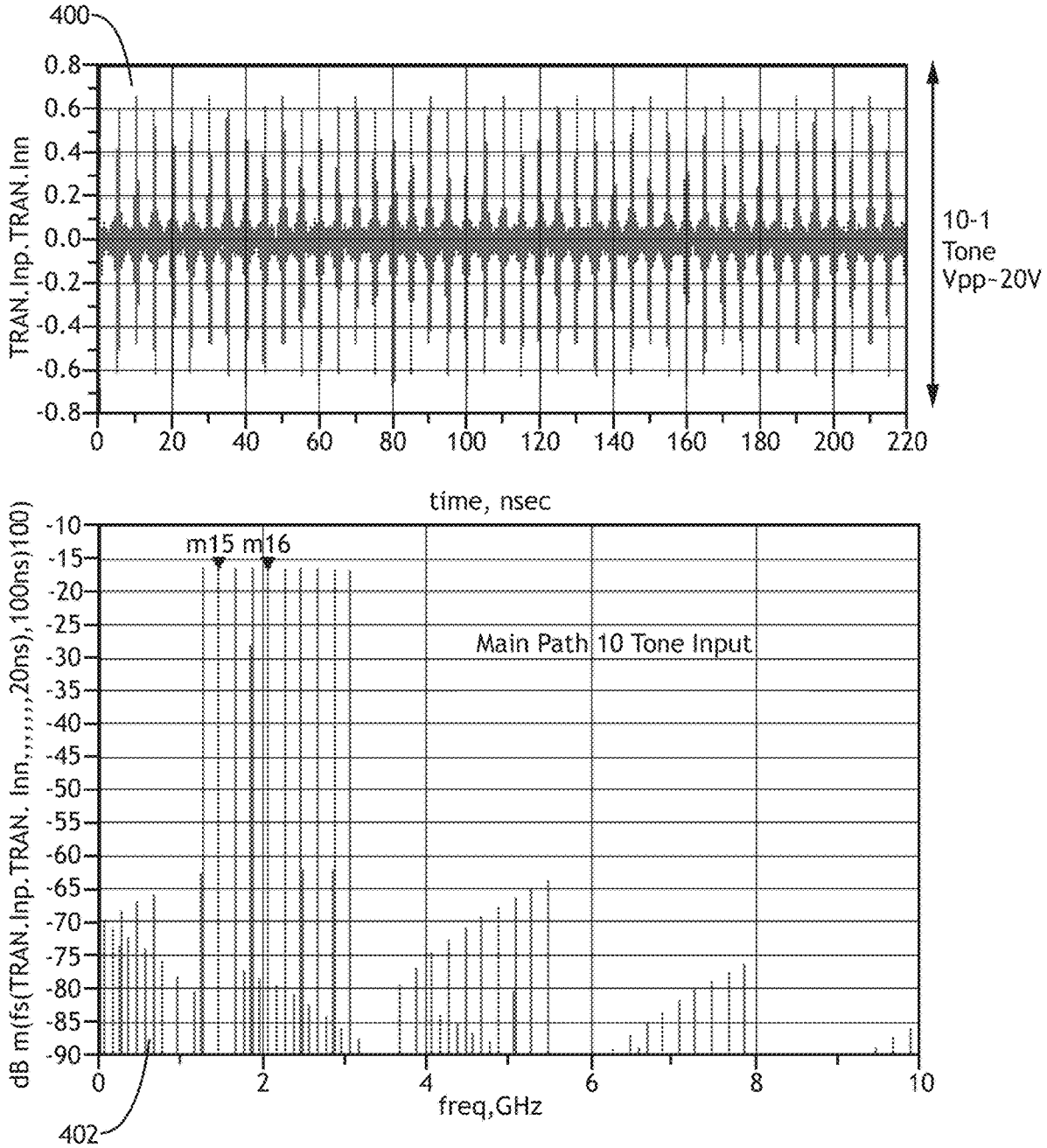
FIG. 4A shows a graph representing input combined signals at the front end of a transmit chain where the individual signals are small and largely free from nonlinear transistor behaviors which can intermodulate and spread energy into accompanying energy sideband frequencies during a process of producing a wideband jamming signal with null bands.
Figure 4B:
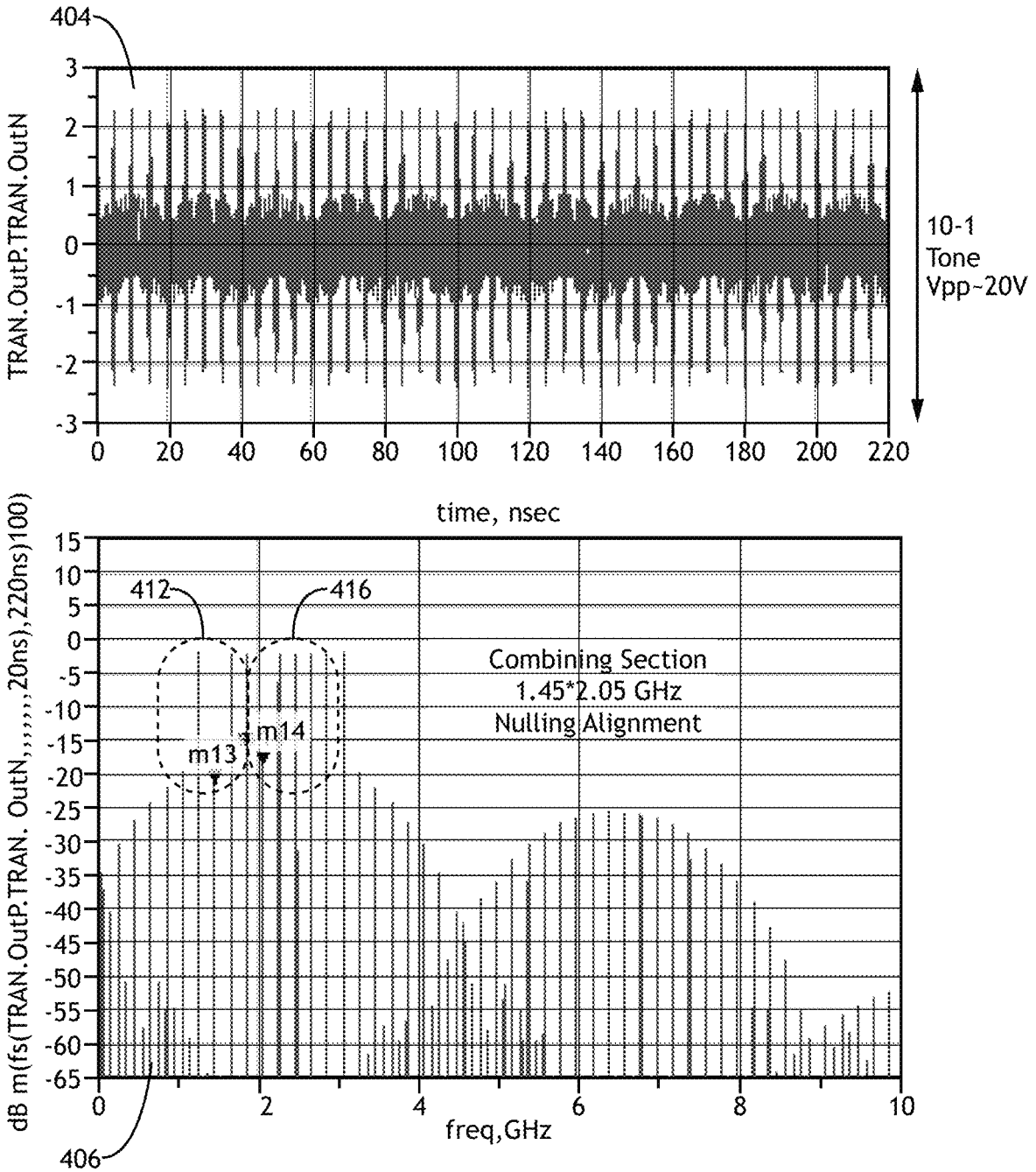
FIG. 4B shows a graph representing signals at the input to the final PA input where the combined signals from 1A are starting to have nonlinear intermodulation effects and spreading of energy into adjacent frequency regions is occurring during a process of producing a wideband jamming signal with null bands.
Figure 4C:
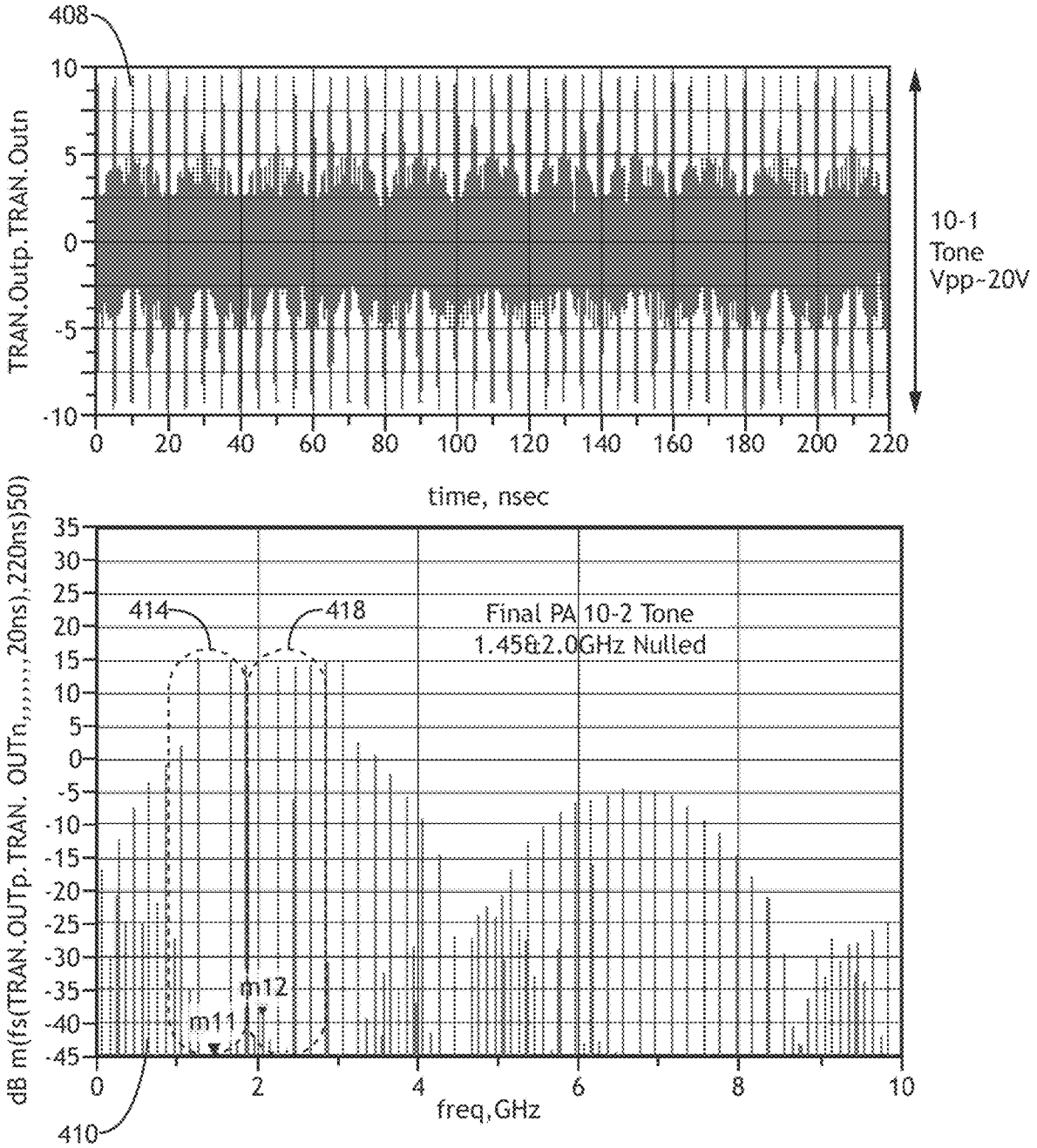
FIG. 4C shows a graph representing signals at the output of the PA which includes all the nonlinear intermodulation effects and spreading of energy into adjacent frequencies during deep compression and nonlinear behavior of the PA during a process of producing a wideband jamming signal with two null bands.

Referring to FIGS. 4A-2C, a graph representing input combined signals at the front end of a transmit chain, a graph representing signals at the input to the final PA input, and a graph representing signals at the output of the PA with a plurality of null bands are shown. Combined transient waveforms 400 having an amplitude and frequency distribution 402 are combined via a nonlinear pre-drive amplifier to an intermediate transient output signal 404 having a combined power distribution 406.

At this intermediate point in the transmit cascade the intermodulation and spectral spreading of the input signals, modifications to the combined transient waveforms 400, or separate nulling signals generated in a separate generation path, produce one or more preliminary null regions 412, 416.

The combined tonal pre-driver output signal 404 is amplified via a high power GaN PA into a final output signal 408 with an output power distribution 410. Nonlinearity behaviors in the high power GaN PA produce a plurality of nulls 414, 418 at a desired band.

In at least one embodiment, the input signals 400 may be modified via a trained neural network, or an algorithm associating the plurality of signals of the input signals 400, or final output signal 408, and a band of desired availability, to identify a signal, one or more tonal components of a signal, or one or more modifications to the plurality of signals, that when incorporated into the transient output signal 404 going into the final high power GaN PA in the cascade produces the plurality of nulls 414, 418 in the combined power distribution 408 at the band of desired availability. It may be appreciated that because of nonlinear behavior of transistor junctions and the interactions of all the input signals, and the response when combining signals, the amplitude and phase of the identified signal are not intuitive, but may be determined via iterative processes. In at least one embodiment, sampling to iterative processing is performed after the final high power GaN PA where each transistor in each circuit along the cascade creates intermodulation, harmonics, and mixing components of all the input signals that spreads energy and signals to more frequencies. Because the gap in energy and frequency is filled in by all the mixing, harmonics, and intermodulation, interactions of the nonlinear devices and circuits, iteration and sampling are required to identify inputs that produce the plurality of nulls 414, 418.

Modifications are applied to the input of the cascade from the DAC's or signal generators used to create the input jamming signals. The modifications unravel the intermodulation, mixing, spreading, regrowth, harmonics, etc. from all the signals going through the nonlinear junctions of the transistors in the circuits to get the best null 414, 418 at the final output signal 408 in the desired band.

In at least one embodiment, the signal, or one or more tonal components of the signal, are produced in a separate generation channel via a separate signal generator, and later combined with the wideband jamming input signals. In at least one embodiment, the one or more signal generators incorporate the one or more modifications to the plurality of signals during generation.

The combined tonal output signal 404 (either modified or including the identified tonal components to produce a one or more preliminary null regions 412, 416 that results in the plurality of nulls 414, 418) is amplified via one or more amplifiers into a final output signal 408 with an output power distribution 410 including the plurality of nulls 414, 418 at the band of desired availability. In at least one embodiment, the wideband jamming signal may be amplified independently from the signal configured to produce the plurality of nulls 414, 418. The one or more preliminary null regions 412, 416 are necessarily not deep nulls on the PA input or pre-driver input. The linear section null attenuation is less than the final null 414, 418 due to the difference in linear versus nonlinear behaviors. The nulling path has fewer signals and requires lower overall output power capability than the wideband jamming signal generation.

Figure 5:
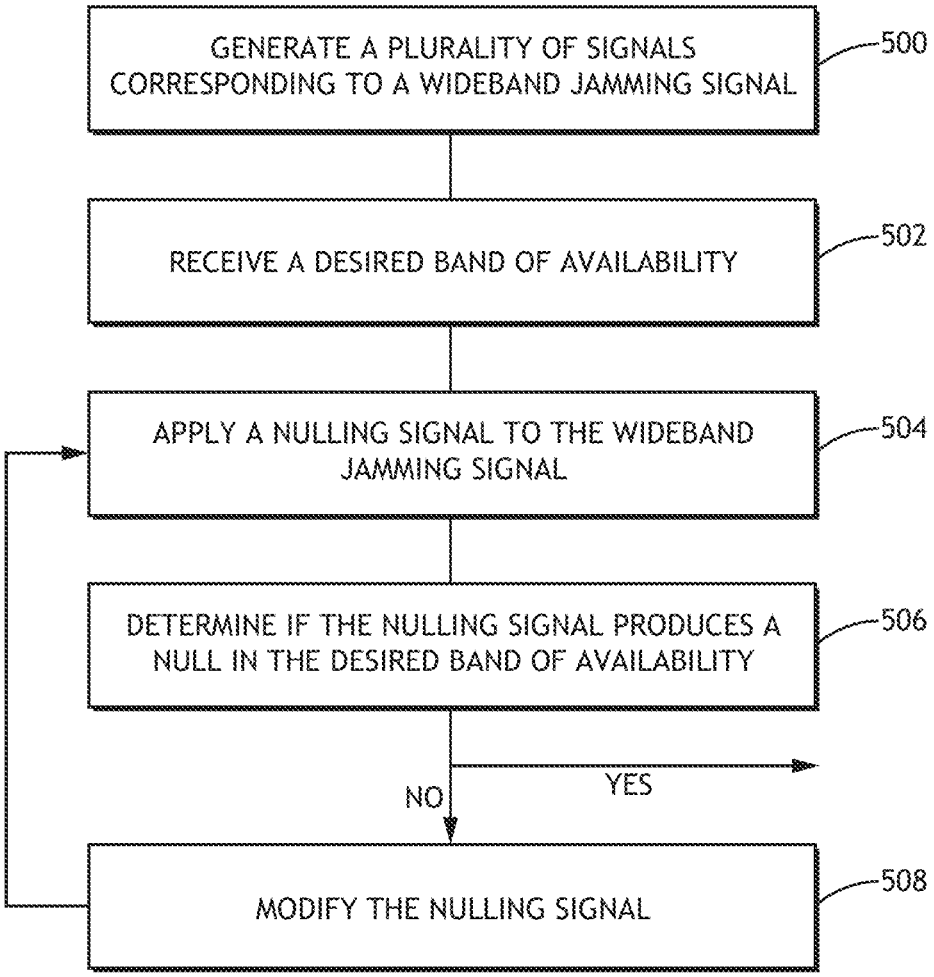
FIG. 5 shows a flowchart of a method for producing wideband jamming signal with a null band.

Referring to FIG. 5, a flowchart of a method for producing wideband jamming signal with a null band is shown. A wideband jamming signal is generated 500 via one or more high-speed DAC signal generators. A processor receives the wideband jamming signal or signal components of the wideband jamming signal via sampling after jamming signal components are combined via one or more power amplifiers where nonlinearity behavior causes the combined signal to expand and fill in gaps. The processor receives 502 a band of desired availability, determines a nulling signal and applies 504 the nulling signal to the wideband jamming signal, either by modifying the amplitude and/or phase of one or more of the tonal components or generating a separate nulling signal via a separate set of nulling tonal components. The processor then determines 506 if the nulling signal produces a null at the band of desired availability when the combined wideband jamming signal and nulling signal are amplified; if so, the combined signal is sent to a GaN wideband differential power amplifier for transmission.

If the nulling signal does not produce the desired null, the processor modifies 508 the nulling signal and reapplies 504 the nulling signal to the wideband jamming signal. In at least one embodiment, the processor implements a trained neural network to produce the nulling signal based on the band of desired availability. The process of modifying 508 and reapplying 504 the nulling signal may be iteratively repeated until the nulling signal produces a null at the band of desired availability within a predetermine threshold.

In at least one embodiment, the wideband jamming signal with nulls may be produced during an up-conversion process by taking baseband or low IF DAC outputs and mixing these up higher RF frequencies.

It is believed that the inventive concepts disclosed herein and many of their attendant advantages will be understood by the foregoing description of embodiments of the inventive concepts disclosed, and it will be apparent that various changes may be made in the form, construction, and arrangement of the components thereof without departing from the broad scope of the inventive concepts disclosed herein or without sacrificing all of their material advantages; and individual features from various embodiments may be combined to arrive at other embodiments. The form herein before described being merely an explanatory embodiment thereof, it is the intention of the following claims to encompass and include such changes. Furthermore, any of the features disclosed in relation to any of the individual embodiments may be incorporated into any other embodiment.

What is claimed is:

1. A system comprising:

a one or more signal generators, at least one signal generator in the one or more signal generators configured to generate a wideband jamming signal by combining a plurality of signals;

at least one amplifier connected to the at least one signal generator; and at least one processor in data communication with the one or more signal generators and a memory embodying processor executable code to configure the at least one processor to:

receive the wideband jamming signal from the at least one signal generator;

receive a signal band of desired availability; and determine a nulling signal configured to reduce signal strength in a band of the wideband jamming signal corresponding to the signal band of desired availability but not in the remainder of the wideband jamming signal after combining the plurality of signals via the at least one amplifier where the at least one amplifier distorts the combined signals via nonlinearity behavior.

2. The system of claim 1, wherein the at least one processor is further configured to determine a plurality of components to the nulling signal, each of the plurality of components corresponding to a change in one or more of amplitude and phase of a signal in the plurality of signals.

3. The system of claim 2, wherein the at least one processor is further configured to alter each of the plurality of signals according to the corresponding component.

4. The system of claim 2, wherein:

the one or more signal generators comprises:

a first signal generator configured to generate the wideband jamming signal by combining a plurality of signals; and a second signal generator configured to generate the nulling signal by combing the plurality of components; and the signals from the first signal generator and the second signal generator are combined.

5. The system of claim 1, wherein determining the nulling signal comprises the at least one processor implementing a neural network trained to determine a plurality of nulling signal components based on the plurality of signals and the signal band of desired availability.

6. The system of claim 1, wherein determining the nulling signal comprises the at least one processor iteratively modifying a preliminary nulling signal via feedback until the wideband jamming signal includes a null band in the signal band of desired availability within a predefined threshold.

7. A method comprising:

receiving a wideband jamming signal from at least one signal generator;

receiving a signal band of desired availability; and determining a nulling signal configured to reduce signal strength in a band of the wideband jamming signal corresponding to the signal band of desired availability but not in the remainder of the wideband jamming signal after combining a plurality of signals via at least one amplifier where the at least one amplifier distorts the combined signals via nonlinearity behavior.

8. The method of claim 7, further comprising determining a plurality of components to the nulling signal, each of the plurality of components corresponding to a change in one or more of amplitude and phase of a signal in the plurality of signals.

9. The method of claim 8, further comprising altering each of the plurality of signals according to the corresponding component.

10. The method of claim 8, wherein:

the wideband jamming signal is garneted by a first signal generator in the at least one signal generator; and further comprising generating the nulling signal with a second signal generator.

11. The method of claim 7, wherein determining the nulling signal comprises implementing a neural network trained to determine a plurality of nulling signal components based on the plurality of signals and the signal band of desired availability.

12. The method of claim 7, wherein determining the nulling signal comprises iteratively modifying a preliminary nulling signal via feedback until the wideband jamming signal includes a null band in the signal band of desired availability within a predefined threshold.

* * * * *